United States Patent [19]

Sterling

[11] 4,205,533

[45] Jun. 3, 1980

[54] REFRIGERATOR HAVING A CONTROL INDICATOR OPTIC ARRANGEMENT AND INDICATING METHOD

[75] Inventor: John E. Sterling, Prospect, Ky.

[73] Assignee: General Electric Company, Louisville, Ky.

[21] Appl. No.: 928,932

[22] Filed: Jul. 28, 1978

[51] Int. Cl.[2] ..... F25B 49/00

[52] U.S. Cl. ..... 62/131; 62/275; 200/317; 219/506

[58] Field of Search ..... 62/131, 125, 264, 275; 137/551; 219/506; 200/317, 310

[56] References Cited

U.S. PATENT DOCUMENTS

| | | | |
|---|---|---|---|
| 1,852,707 | 4/1932 | Hoffman | 62/131 |
| 2,129,474 | 9/1938 | Money | 62/131 |
| 2,607,873 | 8/1952 | Sheidler | 200/317 X |
| 2,683,970 | 7/1954 | Jacobs . | |
| 3,120,108 | 2/1964 | Pansing | 62/126 |
| 3,317,696 | 5/1967 | Sanchez | 200/317 X |
| 3,423,581 | 1/1969 | Baer . | |
| 3,633,374 | 1/1972 | Canter | 62/275 |
| 3,718,814 | 2/1973 | Van Slyke . | |

*Primary Examiner*—William E. Wayner
*Attorney, Agent, or Firm*—Frederick P. Weidner; Radford M. Reams

[57] ABSTRACT

A control indicator optic arrangement and indicating method for a refrigerator having an access door, an interior light bulb that is illuminated when the door is open, and antisweat heaters that are energized by an on-off switch. Included is a movable switch member that energizes the antisweat heaters and a shade member slidable in unison with the switch member and having a cutout area. A light transmitting rod from the interior light bulb to the shade member is arranged such that when the switch is in a first position to energize the antisweat heaters the transmitting rod is in alignment with the cutout area of the shade member and in the second position when the antisweat heaters are de-energized it is out of alignment with the cutout area. Thus, with this arrangement there is a visual indicator to alert the refrigerator user to the fact that the antisweat heaters are energized.

10 Claims, 5 Drawing Figures

FIG. 2
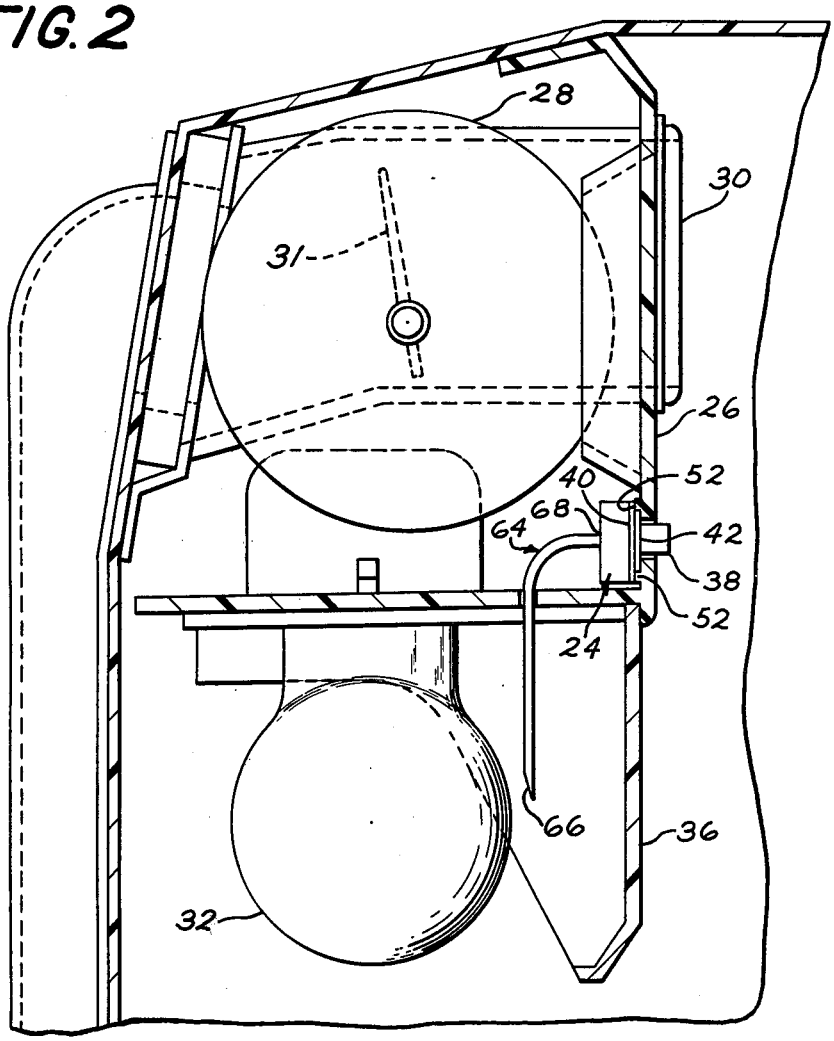
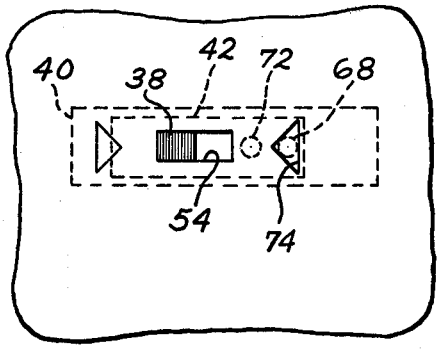
FIG. 4
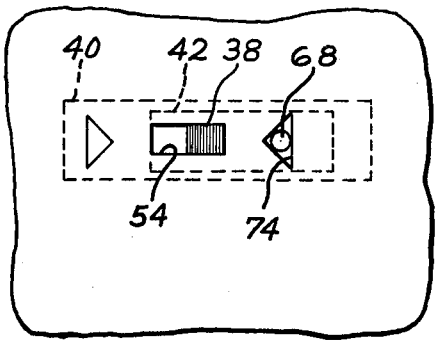
FIG. 5

REFRIGERATOR HAVING A CONTROL INDICATOR OPTIC ARRANGEMENT AND INDICATING METHOD

BACKGROUND OF THE INVENTION

The present invention is directed to a household refrigerator including antisweat heaters which are energized by an on-off switch. More particularly this invention relates to a control indicator optic arrangement and method for indicating when the antisweat heaters are energized.

Many household refrigerators have electric resistance antisweat heaters located betwen the interior liner and outer case in order to prevent condensation of humid, outside air on the cold surface of the case. There is normally provided a manually operated switch where the user of the refrigerator may energize the antisweat heaters or not energize them depending upon the humidity conditions of the atmosphere. Such a switch is normally referred to as a power saver switch or energy saver switch which will allow the user to turn off the heaters when not needed thus saving electrical energy.

Optic illuminator arrangements in various apparatus including refrigerators have been utilized in the past. For instance U.S. Pat. No. 3,718,814 discloses the use of fiber optic light conductors to provide illumination at a location remote from a light source. U.S. Pat. No. 3,120,108 discloses the use of a plastic light transmitting rod which has one end located adjacent the light bulb of a refrigerator and the other end arranged in alignment with an opening to activate a photo-conductor in a defrost control.

By the present invention, there is provided a control indicator optic arrangement and method which visually indicates to the user of the refrigerator that the antisweat heaters are energized.

SUMMARY OF THE INVENTION

There is provided in a refrigerator having an access door and an interior light bulb that is illuminated when the door is open and antisweat heaters that are energized by an on and off switch, an optic arrangement and indicating method to indicate when the heaters are energized. The optic arrangement includes a movable switch member that energizes the antisweat heaters in a first position and deenergizes the heaters in a second position. A shade member with a cutout area slidable in unison with the movable switch member is provided. There is a light transmitting rod having one end located adjacent the interior light bulb and the other end adjacent the shade member such that when the switch is in the first position the transmitting rod is in alignment with the cutout area of the shade member and in the second position it is out of alignment with the cutout area. With this arrangement then when the refrigerator door is opened the interior light bulb is illuminated and light is transmitted through the transmitting rod. If the antisweat heater switch is in the energizing position light will be transmitted so that the user may visually see the emitted light and be alerted to the fact that the antisweat heaters are energized. If the antisweat heater switch is in the de-energizing position, the shade member prevents light being transmitted as it blocks the end of the light transmitting rod and the user does not see the emitted light.

BRIEF DESCRIPTION OF THE DRAWINGS

FIG. 2 is a sectional view showing the control indicator optic arrangement of the present invention taken along lines 2–2 of FIG. 1.

FIG. 4 shows the control indicator optic arrangement energizing switch in the off position.

FIG. 5 is the same as FIG. 4 but showing the energizing switch in the on position.

DESCRIPTION OF THE PREFERRED EMBODIMENT

Figure 1:
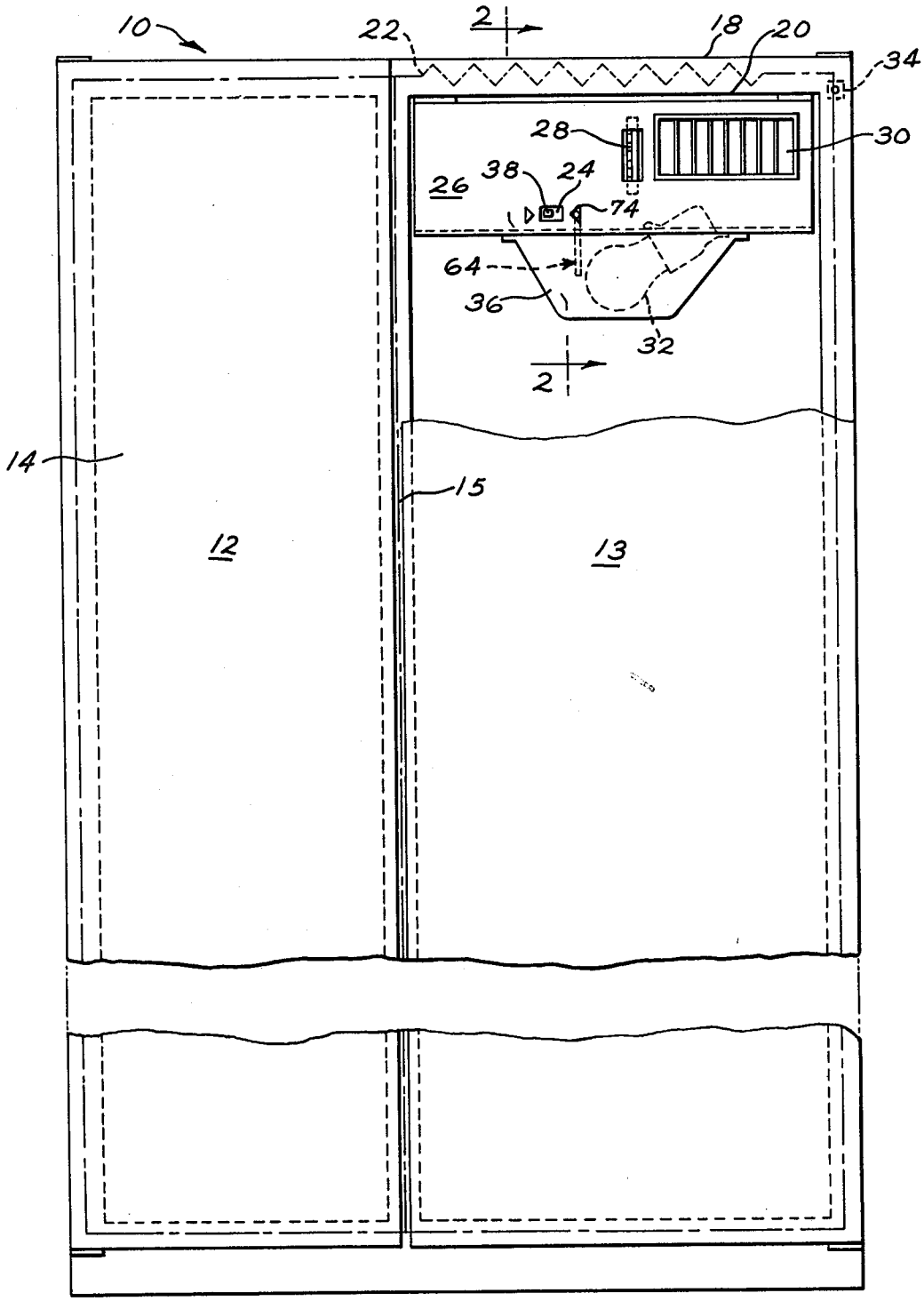
FIG. 1 is a front elevational view, partly broken away, of a side-by-side refrigerator showing both the fresh food compartment and the freezer compartment and including the control indicator optic arrangement of the present invention.

Referring to FIG. 1, a refrigerator 10 such as a household refrigerator, for example, has a freezing compartment 12, and a fresh food compartment 13 separated by an insulated partition 15. The freezer compartment has a door 14 and the fresh food compartment has a door 17 for closing the respective compartments. The fresh food compartment 12 has an outer case 18 and an interior liner 20 the former being metal and the latter usually is plastic. Between the interior liner 20 and the outer case 18 there is insulation and also an electrical resistance antisweat heater 22 which when energized will conduct heat to the outer case 18 so that during humid conditions moisture from the atmosphere will not condense on the outer case. The antisweat heaters are energized by an on-off switch 24, usually manually actuated, located on the interior of the fresh food compartment. In this embodiment the switch 24 is secured to and located on a stationary panel 26 near the top of the fresh food compartment 13. The panel 26 also accommodates a temperature control 28 and air vents 30. As is well known, the temperature control is rotatable and moves a flapper valve 31 to adjust the amount of cold air being circulated from the freezer into the fresh food compartment via the vents 30.

Located also within the fresh food compartment is a light bulb 32 which is illuminated through a switch 34 located and in cooperation with the access door 17 so that only when the door is opened the light bulb 32 will be illuminated. The light bulb normally is partially covered by a downwardly depending cover 36 so that the light does not shine directly in the eyes of the person opening the access door 17.

While the antisweat heater switch 24 may have indicators on them which will tell the user if the switch is in the on or off position it is an aspect of this invention to bring the attention to the refrigerator user that the antisweat heaters are energized. To this end, it is desirable to provide a light emitting indicator which will visually alert the user whenever the user opens the fresh food access door that the antisweat heater is energized. The on-off switch 24 is desirably located at near eye level of the user and in front of the panel 26 where it will be readily noticed.

Figure 3:
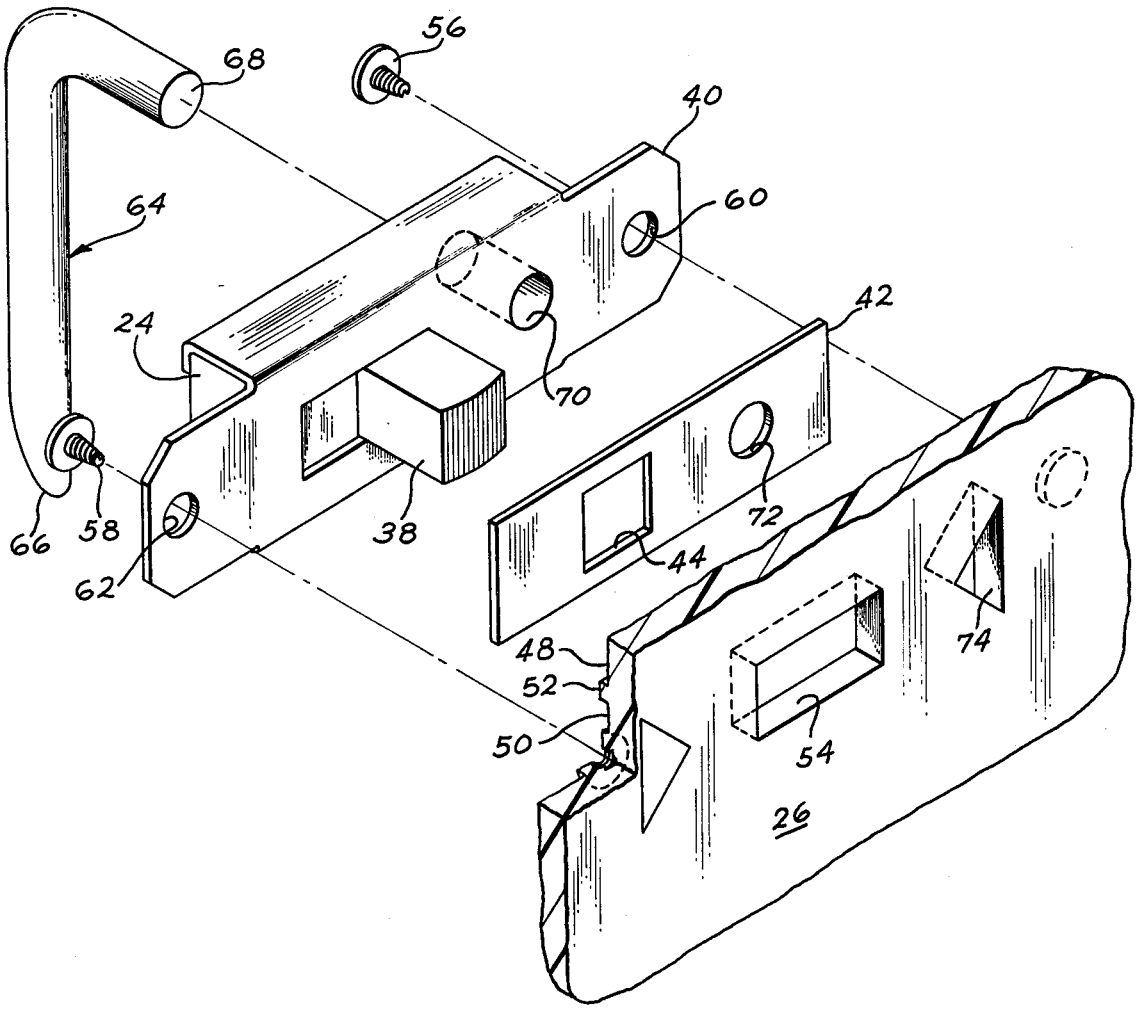
FIG. 3 is an exploded perspective view of the energizing switch for control indicator optic arrangement of the present invention.

With reference particularly to FIGS. 2 and 3, the control indicator optic arrangement will be discussed. The on-off switch 24 includes a movable switch member 38 that may be moved manually by the refrigerator user back and forth between a first position which will through an appropriate electrical circuit energize the antisweat heaters 22 and in a second position will de-energize the antisweat heaters 22. The movable switch member 38 is retained in its proper position on the panel 26 by a mounting bracket 40 secured in a suitable manner to the panel. The on-off switch 24 cooperates with a shade member 42 which is opaque and has an opening 44 through which the movable switch member 38 projects. The shade member 42 is dimensioned so that movement of the switch member 38 causes the shade member to slide in unison back and forth therewith. The indicator optic arrangement may, if desired, also include a separate faceplate, however, in this embodiment the panel 26 acts as a faceplate and as on the interior surface 48 a groove 50 formed by ribs 52 which are dimensioned to receive therebetween the shade member 42. This allows the shade member 42 to move in the groove 50 back and forth in unison with the movable switch member 38. The faceplate panel 26 also includes an opening 54 through which switch member 38 projects. The four members, namely, switch 24, mounting bracket 40, shade member 42, and the faceplate 26 are assembled and held together by means of screws 56 and 58 passing through holes 60 and 62, respectively, of the mounting bracket 40 and into the rear of the faceplate panel 26 thus capturing between them in a sandwich fashion the shade member 42.

There is provided in the control indicator optic arrangement a light transmitting rod 64 having one end 66 located adjacent light bulb 32 and the opposite end 68 adjacent the shade member 42. For this purpose then there is provided a bore 70 through the on-off switch 24 and its mounting bracket 40 so that the end 68 of the light transmitting rod 64 may pass through and be adjacent the shade member 42. The shade member 42 has a cutout area 72 which is located such that when the movable switch member 38 is in the first position to energize the antisweat heaters the transmitting rod end 68 is in alignment with the cutout area 72 of the shade member 42. When the movable switch member 38 is in the second position and the antisweat heaters are deenergized, the shade member will slide in unison with the switch member 38 and the end of the light transmitting rod 68 will not be in alignment with the cutout area 72 and light being emitted from the end 68 of rod 64 will be blocked. When a faceplate, such as panel 26, is included in the arrangement in order for the user of the refrigerator to have indicated when the antisweat heaters are energized there is provided in the faceplace a cutout area 74 which is in alignment with the end 68 of the rod 64.

With the above-described control indicator optic arrangement, when the user of the refrigerator opens the access door 17 of the fresh food compartment the light bulb 32 through door switch 34 and appropriate electrical circuitry is illuminated. When the switch member 38 is in the first position and the antisweat heaters are energized, light will be transmitted from the light bulb 32 through the light transmitting rod 64 and will pass through cutout area 72 in the shade member 42 and also through cutout area 74 in the faceplate 26. FIG. 5 represents this position of the elements or members of the indicator optic arrangement. The user will be visually alerted by the emitted light to the fact that the antisweat heaters are energized. When the movable switch member 38 is in the second or off position and the antisweat heaters are not energized, then cutout area 72 of shade member 42 is out of alignment with the end 68 of the light transmitting rod 64 ane the shade member will block the passage of any light emitted therethrough thus there is not indicated through the cutout area 74 of the faceplate 26 that the antisweat heaters are energized. This position of the elements or members of the indicator optic arrangement is shown in FIG. 4.

The foregoing is a description of the preferred embodiment of the invention and it should be understood that variations may be made thereto without departing from the true spirit of the invention as defined in the appended claims.

What is claimed is:

1. In a refrigerator having an access door, an interior light bulb that is illuminated when the door is open, and antisweat heaters that are energized by an on and off switch, an optic arrangement to indicate when the heaters are energized comprising:

(a) a movable switch member that energizes the heaters in a first position and de-energizes the heaters in a second position, (b) a shade member slidable in unison with the movable switch member and having a cutout area, and (c) a light transmitting rod having one end located adjacent the interior light bulb and the other end adjacent the shade member such that when the switch is in the first position the transmitting rod is in alignment with the cutout area of the shade member and in the second position it is out of alignment with the cutout area.

2. In the refrigerator of claim 1 wherein there is also included a faceplate the faceplate having a cutout area in alignment with the end of the light transmitting rod adjacent the slide member.

3. In the refrigerator of claim 2 wherein the shade member is slidably retained in grooves on the interior surface of the faceplate.

4. In the refrigerator of claim 1 wherein the on and off switch is manually actuated by the movable switch member.

5. In the refrigerator of claim 4 wherein the shade member has an opening through which the movable switch member projects and movement of the switch causes the shade member to slide.

6. In the refrigerator of claim 5 wherein there is also included a faceplate through which the movable switch member projects, the faceplate having a cutout area in alignment with the end of the light transmitting rod adjacent the slide member.

7. In the refrigerator of claim 2 wherein the faceplate is a stationary panel to which the on and off switch is secured.

8. In a refrigerator having an access door, an interior light bulb that is illuminated when the door is open, and an antisweat heater energized by an on and off switch movable to a first position to energize the heater and a second position to de-energize the heater, a method of visually indicating whether the antisweat heater is energized or de-energized comprising the steps of;

(a) moving a switch element to either the first or second position, (b) opening the door to illuminate the light bulb, (c) transmitting light from bulb through a light transmitting rod, and (d) blocking the emitter light as it leaves the rod only when the switch element is in the second position so that the refrigerator user will see the emitted light from the rod when the switch element is in the first position.

9. The method of claim 8 wherein blocking the transmitted light is accomplished by sliding a shade in front of the light transmitting rod where the emitted light leaves the rod.

10. The method of claim 9 wherein sliding the shade in front of the light transmitting rod is accomplished by moving the shade in unison with the switch element when the switch element is moved to the second position.

* * * * *